United States Patent [19]

Wade

[11] 4,205,888

[45] Jun. 3, 1980

[54] GROUND CONNECTOR FOR INTERLOCKED ARMOR ELECTRICAL CABLE

[76] Inventor: Jack W. Wade, 1704 E. North Hamilton St., High Point, N.C. 27262

[21] Appl. No.: 905,422

[22] Filed: May 12, 1978

[51] Int. Cl.[2] ..... H01R 3/06

[52] U.S. Cl. ..... 339/14 R; 174/78; 339/61 R; 403/229

[58] Field of Search ..... 174/78, 73 R; 403/229, 403/185; 339/14 R, 14 L, 60 R, 61 R

[56] References Cited

U.S. PATENT DOCUMENTS

| | | | |
|---|---|---|---|
| Re. 28,837 | 6/1976 | Silva | 174/78 |
| 1,448,367 | 3/1923 | Thomas, Jr. | 403/185 |
| 1,861,532 | 6/1932 | Hough | 403/229 X |
| 3,312,772 | 4/1967 | Sherlock | 174/78 X |
| 3,315,024 | 4/1967 | Ball | 174/78 X |

*Primary Examiner*—Roy Lake
*Assistant Examiner*—DeWalden W. Jones
*Attorney, Agent, or Firm*—Bell, Seltzer, Park & Gibson

[57] ABSTRACT

A connector adapted to be positioned on an end of an armored electrical cable of the type having protective flexible cable armor formed by interlocked helical convolutions of a metallic strip and serving for facilitating securing a grounding conductor to the cable armor. The connector comprises an electrically conductive spring-like element having a plurality of helical turns. The spacing and pitch of the helical turns of the connector correspond to the spacing and pitch of the helical convolutions of the cable armor for threadedly engaging the helical convolutions. One end portion of the spring-like element extends longitudinally away from the helical turns to position the end of the element in a readily accessible location for connection of a grounding conductor thereto. The connector may optionally additionally include a flexible sleeve adapted for receiving and tightly engaging the end portion of the cable armor with the spring-like element positioned thereon and securing the end portion of the cable armor to an electrical panel or junction box.

12 Claims, 8 Drawing Figures

GROUND CONNECTOR FOR INTERLOCKED ARMOR ELECTRICAL CABLE

FIELD OF THE INVENTION

This invention relates to electrical conductors, and more particularly relates to a connector for use with interlocked armor electrical cable for facilitating connecting a grounding conductor to the cable armor.

BACKGROUND OF THE INVENTION

Electrical cable of the type known as "interlocked armor cable" is widely used in power distribution systems in commercial and industrial applications. This type of cable consists of one or more insulated electrical conductors encased in a protective interlocked armor. The interlocked armor is made from a strip of metallic material, usually galvanized steel, helically wound around the conductors and interlocked upon itself to form a flexible tubular protective covering for the conductors. In some applications the interlocked armor cable includes an outer coating or jacket of vinyl.

At the terminations of the electrical cables where connections are made to the electrical conductors, it is generally necessary to ground the metallic interlocked cable armor by securing a grounding conductor to the cable armor. This has been conventionally done in various ways. For example, where a large number of cables terminate at a common location, one widely used means for grounding the cable armor involves using a clamp similar to a radiator hose clamp and a grounding lead. The clamp is positioned over the end of the cable armor and the grounding lead is positioned between the clamp and the cable armor. The clamp is then tightened to secure the grounding lead to the cable armor. The grounding lead may then be secured to a suitable grounding conductor. It should be apparent that this practice has several disadvantages and limitations. The need for several separate parts in order to effect a single connection is cumbersome for the workman and is relatively expensive. The presence of a clamp at the end of each cable causes a protrusion on each cable which makes it difficult to group the cables in a compact neat arrangement. Additionally, this practice is relatively time consuming and difficult to accomplish when working in narrow or confined areas.

Where single cables terminate at a junction box or electrical panel, special terminating fittings are generally employed. One well known type of terminating fitting, often referred to as a "PLM" fitting, is made of cast metal and incorporates a set screw type arrangement for securing the fitting to the interlocked cable armor and threaded bushings or nuts for securing the terminating fitting to the panel. Terminating fittings of this type are relatively expensive and time consuming to install, usually requiring tools such as screwdrivers and/or wrenches for installation.

With the foregoing in mind, it is an important object of the present invention to provide a connector which is particularly designed for use with interlocked armor cable for facilitating connecting a grounding conductor to the cable armor, and which is considerably more economical and easier to use and install than the presently available connectors or clamps for use with interlocked cable armor.

it is another object of this invention to provide a connector of the type described which is particularly suited for use where a relatively large number of interlocked armor cables terminate at a common location, and which permits the cables to be grouped in a more compact and neat arrangement than with the practices presently available.

It is still another object of this invention to provide a connector of the type described which is also useful for securing a single interlocked armor cable to a junction box or panel while also facilitating connecting a grounding conductor to the cable armor.

SUMMARY OF THE INVENTION

These and other objects are accomplished in accordance with the present invention by the provision of a connector comprising an electrically conductive spring-like element having a plurality of helical turns. The spacing and pitch of the helical turns of the spring-like element correspond to the spacing and pitch of the helical convolutions of the cable armor to permit the spring-like element to be threadably engaged onto the end of the cable armor. One end portion of the spring-like element extends longitudinally away from the helical turns to position the end of the element in a readily accessible location for connection of a grounding conductor thereto. The grounding conductor can be readily secured to the projecting end of the spring-like element by means of a crimpable sleeve or by other suitable means.

Preferably, the projecting end portion of the spring-like element is substantially straight and extends in a direction generally parallel to the axis of the helical turns. The end portion is offset from the axis of the helical turns a distance preferably no greater than the radius of the helical turns so that there are no projecting portions which would prevent the cables from being grouped and nested closely together in a compact and neat arrangement.

The spring-like connector element can be used by itself on the end of cable armor in the manner described, or in accordance with another aspect of the invention, the connector element can be used in conjunction with a flexible elastomeric sleeve for securing the cable armor to an electrical panel or junction box. The sleeve is of generally cylindrical configuration and of a size corresponding to the outside dimensions of the cable armor and is adapted to surroundingly engage the spring-like element and the cable armor secured thereto. The sleeve has cylindrical side wall portions adapted for tightly engaging the exterior of the cable armor and forming a watertight seal therewith. The cylindrical sleeve has one open end adapted for receiving the end portion of the cable armor therein, with the opposite end of the sleeve being closed. A fastener in the form of a projection or protrusion extending from the closed end of the sleeve permits the sleeve to be secured to a restricted knock-out opening of an electrical panel or junction box. More particularly, the projection which serves as a fastener means is of a diameter slightly larger than the diameter of the restricted knock-out opening and formed of a deformable and resilient material so as to pass through the restricted knock-out opening when pushed into place and to thereafter return to its original configuration for securing the sleeve to the panel. Preferably, the outer surfaces of the projection are of an angular, tapered configuration to facilitate passing the projection through the opening.

The spring-like ground connector element of this invention has numerous advantages over the types of connectors which have been heretofore available for effecting grounding of interlocked cable armor. Because of the simple construction, the spring-like connector element can be manufactured at relatively low cost. The connector element is considerably easier and quicker to install and use than the prior types of ground connectors, thus providing an additional cost savings as a result of reduced installation time. As earlier noted, the compact configuration of the spring-like connector element permits large numbers of cables to be grouped in a more compact, neat arrangement than has previously been possible. Additionally, it has been determined that the spring-like configuration serves to reinforce the end portion of the armor and to prevent unraveling of the helically wound strip which forms the armor as may sometimes occur.

BRIEF DESCRIPTION OF THE DRAWINGS

Some of the objects, features and advantages of the invention having been described, others will appear as the description proceeds, when taken in connection with the accompanying drawings, in which.

DESCRIPTION OF THE ILLUSTRATED EMBODIMENTS

Figure 1:
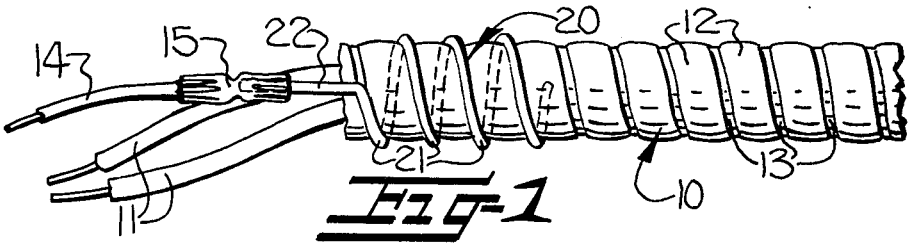
FIG. 1 is a plan view of an end portion of an interlocked armor electrical cable to which a ground connector in accordance with this invention has been secured for effecting grounding of the cable armor.

Referring now more particularly to the drawings, an end portion of an interlocked armor electrical cable is indicated generally in FIG. 1 by the reference character 10. The cable consists of several insulated electrical conductors 11 encased in a protective flexible tubular interlocked armor 12. The armor is made from a strip of galvanized steel helically wound and interlocked upon itself around the cable core to form a flexible tubular protective jacket or sheath for the completed cable. As illustrated, a connector member in the form of a spring-like element is threaded onto the end of the cable. The spring-like element, generally indicated by the reference character 20, is formed from a relatively heavy gauge metallic wire and has a plurality of helical turns 21 of a spacing and pitch corresponding to the spacing and pitch of the helical convolutions of the cable armor 12. The spring-like element may thus be readily threaded onto the end of the cable, with the helical turns 21 nesting in the helical groove 13 which extends over the exterior surface of the cable armor 12 and which is formed at the juncture between adjacent convolutions of the armor.

Figure 3:
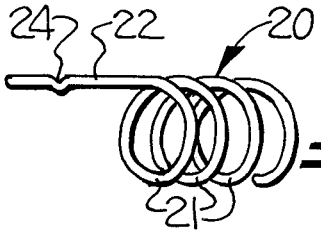
FIGS. 3 and 4 are perspective views and end views, respectively, showing a configuration for the ground connector in accordance with one embodiment of the invention.

One end portion 22 of the spring-like element 20 is substantially straight and extends away from the helical turns 21 in a direction generally parallel to the axis of the turns. As best seen in FIG. 1, when the spring-like element is threadably engaged onto the end of the cable, the end portion 22 of the spring-like element projects beyond the end of the cable so as to be readily accessible for connection of a grounding conductor thereto. In the arrangement shown in FIG. 1 a grounding conductor is indicated by the reference character 14 and is secured to the end portion 22 of the spring-like element 20 by a sleeve 15 which has been slipped over the grounding conductor 14 and the end portion 22 of the spring-like element and crimped in place by pliers or another suitable tool. Other well known and conventional means may be employed for securing the grounding conductor to the end portion of the spring-like element. To facilitate obtaining a secure connection between the grounding conductor and the spring-like element, the end portion 22 of the spring-like element is preferably formed with surface irregularities or indentions 24 therein (FIG. 3).

Figure 2:
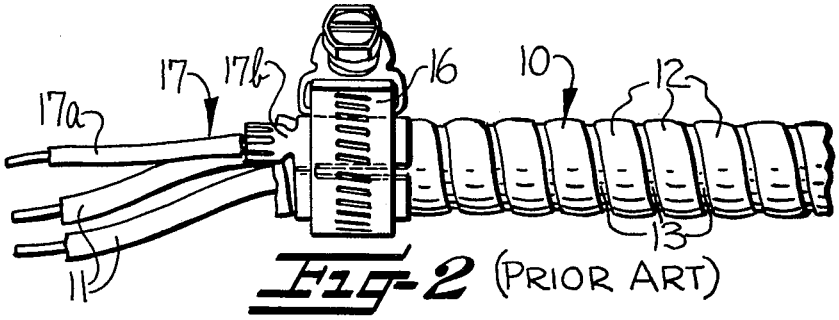
Fig-2 (PRIOR ART)
FIG. 2 is a view similar to FIG. 1, but showing a conventional means heretofore used for effecting grounding of the cable armor.

FIG. 2 illustrates one of the practices which has been heretofore employed for securing a grounding conductor to an interlocked armor cable. In accordance with this prior practice a clamp 16 similar to a radiator hose clamp is slipped over the end portion of the cable and grounding lead 17 is positioned between the cable and the clamp 15. As illustrated, the grounding lead 17 consists of a short length of wire **17*a*, with a small flat metallic wire connector or "flag" 17*b* crimpably secured to one end of the wire. The connector or "flag" 17*b* is positioned between the cable armor 12 and the clamp 16, and the clamp is then manually tightened to secure the grounding lead 17 to the cable. The free end of the wire 17*a*** may then be secured to a suitable grounding conductor.

It should be apparent that this practice is relatively time consuming and cumbersome, requiring several separate parts and also requiring the use of a screwdriver in order to secure the grounding conductor to the cable. When working in confined spaces, as for example inside a junction box or electrical cabinet, it is often difficult to manipulate a screwdriver and secure the grounding conductor to the cable. Additionally, it will be observed that the clamps 16 form a projection on the end portion of the cable. The presence of this projection makes it difficult to group a number of cables in a compact, neat arrangement as is desirable. The connector of the present invention, on the other hand does not provide any kind of projection on the end portion of the cable and thus facilitates the neat arrangement of large numbers of cables.

Numerous other advantages derive from the particular shape and arrangement of the spring-like connector in accordance with this invention. For example, when using this type of connector it is possible to threadably secure the connector in place on the end of the cable prior to introducing the cable through an opening into a junction box or electrical cabinet. It is then a simple matter to secure the grounding conductor to the end portion of the connector using a crimpable sleeve or other suitable means. This practice is not possible or practical when using clamps of the type shown in FIG. 2, since the clamp 16 would be likely to fall off or become misplaced before the end of the cable is positioned at its final point of connection, and further because the projection of the clamp generally prevents the clamp from being installed prior to passing the end of the cable through an opening, and instead requires that the clamp be positioned on the cable only after the cable has been positioned at or near its final point of connection.

Figure 4:
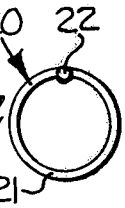

Referring now in more detail to the construction of the spring-like element 20, it will be noted from the drawings that several variations in the particular configuration of the spring-like connector are contemplated. More particularly, as illustrated in FIGS. 3 and 4 the end portion 22 of the spring-like element 20 extends generally parallel to the axis of the helical turns 21 and is offset from the axis of the turns a distance corresponding substantially to the radius of the helical turns.

Figure 5:
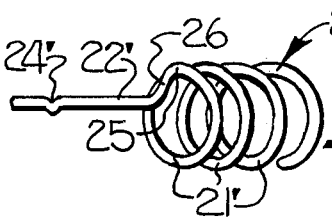
FIGS. 5 and 6 are views similar to FIGS. 3 and 4 but showing a configuration in accordance with a second embodiment of the invention.
Figure 6:
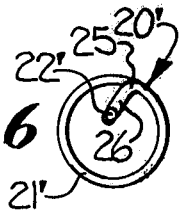

The form of the invention illustrated in FIGS. 5 and 6 is substantially the same, and to avoid repetitive description, the same reference characters, with prime notation added, will be used wherever possible to identify corresponding parts. Basically, the embodiment illustrated in FIGS. 5 and 6 differs over that shown in FIGS. 3 and 4 in that the end portion 22' is offset from the axis of the turns 21' a distance somewhat less than the radius of the helical turns. In accordance with this arrangement, a bend 25 in the spring-like element 20' positions a portion 26 in inwardly extending relation so as to form an abutment stop serving to limit how far the element 20' can be threaded onto the end of the cable. This latter form is also particularly useful in conjunction with the flexible elastomeric sleeve to be described presently.

Figure 7:
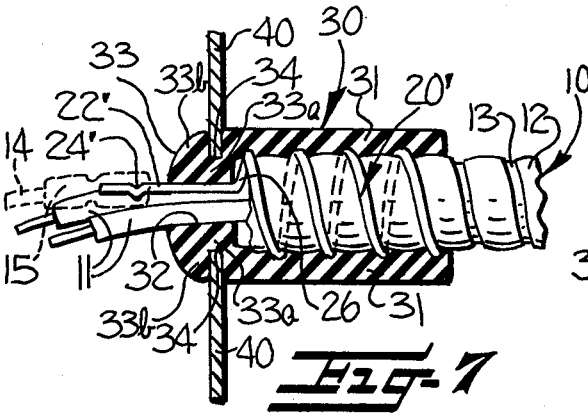
FIG. 7 is a plan view, partially in cross section, showing a further aspect of the invention in which the ground connector is utilized in association with a flexible sleeve for securing the end of the cable armor to an electrical panel or junction box.
Figure 8:
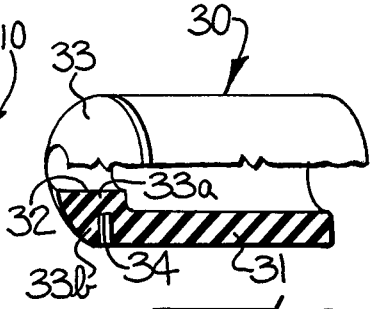
FIG. 8 is a perspective view, partially in cross section, showing the sleeve in greater detail.

In FIG. 7 a cylindrical shaped sleeve member is indicated generally by the reference character 30. Sleeve member 30 is formed of a flexible, resilient material such as a synthetic rubber or other elastomeric material, and is adapted to receive and engage the end portion of a cable therein and secure the cable to a restricted knock-out opening in an electrical panel or junction box 40.

The sleeve member 30, more particularly, has a cylindrical wall portion 31 defining a hollow cylindrical interior area for receiving the end portion of an armored cable therein. The opposite end portion of the sleeve 30 is closed but includes a relatively small restricted passageway 32 for receiving the end portion 22' of the spring-like element 20' in projecting relation therethrough. A projection 33 integrally formed with and extending from the closed end of the sleeve serves as a fastener for permitting securement of the sleeve to a restricted knock-out opening of an electrical panel or junction box 40. As illustrated, the projection 33 includes a relatively narrow neck portion **33*a* extending from the main body portion of the sleeve and an enlarged generally wedge shaped shoulder portion 33*b* carried by the reduced size neck portion and being of a diameter slightly larger than the knock-out opening. A circumferential groove 34 is thus formed in the area of the neck portion 33*a* between the main body portion of the sleeve and the adjacent shoulder portion 33*b*. This groove 34 is adapted to receive the wall of a panel or junction box 40 for mounting the sleeve in place thereon. The projection 33 is deformable so as to collapse upon itself when forced into engagement with the knock-out opening and to pass through the restricted knock-out opening, but is also resilient so as to thereafter return to its original configuration for securing the sleeve to the panel. In this regard it will be noted that the outer surfaces of the shoulder portion 33*b* are of an angular tapered configuration to facilitate passing the projection 33** through the restricted knock-out opening of the panel.

The sleeve 30 may be furnished to the user either with the spring-like element 20 or 20' already in assembled relation inside the sleeve, or separately therefrom. When the sleeve 30 is furnished separately from the spring-like element, the preferred practice for securing the end of the cable to a panel or junction box involves first mounting the sleeve 30 to the panel 40 by pushing the projection 33 through the restricted knock-out opening. Once the sleeve is in place, the end portion of the cable 10, with a spring-like element 20' threadably positioned thereon, is pushed into the open end portion of the sleeve and the electrical conductors 11 and the projecting end portion 22' of the spring-like element 20' are passed through the restricted opening 32 of the sleeve. When the end portion of the cable 10 is fully seated within the sleeve, the cylindrical wall portions 31 tightly engage the side walls of the armored cable and form a watertight seal therewith. The restricted diameter opening 32 at the closed end of the sleeve is of such a diameter as to be substantially filled by the electrical conductors 11 and the end portion 22' of the spring-like connector 20'. In this manner, a substantially permanent connection is effected since the shoulder portion **33*a*** is unable to collapse upon itself to effect removal of the sleeve from its mounted location in the knock-out opening of the electrical panel.

In the drawings and specification, there have been set forth preferred embodiments of the invention, and although specific terms are employed, they are used in a generic and descriptive sense only and not for purposes of limitation.

That which is claimed is:

1. A connector adapted to be positioned on an end of an armored electrical cable of the type having a protective flexible cable armor formed by interlocked helical convolutions of a metallic strip, said connector serving for facilitating securing a grounding conductor to the cable armor and comprising an electrically conductive spring-like element having a plurality of helical turns, the spacing and pitch of said helical turns corresponding to the spacing and pitch of the helical convolutions of the cable armor for threadably engaging the same, and wherein one end portion of said spring-like element is substantially straight and extends longitudinally away from the helical turns in a direction generally parallel to the axis of the helical turns to position the end of the element in a readily accessible location for connection of a grounding conductor thereto.

2. A connector according to claim 1 wherein said one end portion of said spring-like element is offset from the axis of the helical turns a distance no greater than the radius of the helical turns.

3. A connector according to claim 1 wherein said one end portion of said spring-like element has surface irregularities formed therein for facilitating obtaining a secure connection of a grounding conductor thereto.

4. A connector according to claim 1 additionally including a flexible sleeve of generally cylindrical configuration having an axially extending opening at one end thereof of an inside diameter corresponding substantially to the outside diameter of the cable armor and said sleeve having cylindrical side wall portions adapted for tightly engaging the end portion of the cable armor when the end portion of the cable armor, with the spring-like element positioned thereon, is received in the axially extending opening of the sleeve.

5. A connector according to claim 4 wherein the end portion of said sleeve opposite said axially extending opening has a relatively small restricted passageway extending therethrough adapted for receiving said one end portion of said spring-like element in projecting relation therethrough.

6. A connector according to claim 5 including fastener means on said sleeve for securing the sleeve to a restricted knock-out opening in an electrical panel, said fastener means comprising a projection integrally formed with and extending from the end portion of said sleeve opposite said axially extending opening and having said restricted passageway extending centrally therethrough, said projection being formed of a deformable, resilient material for passing through the restricted knock-out opening and thereafter returning to its original configuration for securing the sleeve to the panel.

7. In a termination for armored electrical cable of the type having a protective flexible cable armor formed by interlocked helical convolutions of a metallic strip, the combination with said cable armor of a connector mounted on an end portion of the cable armor and serving for facilitating securing a grounding conductor to the cable armor, said connector comprising an electrically conductive spring-like element having a plurality of helical turns of a spacing and pitch corresponding to the spacing and pitch of the helical convolutions of said cable armor and being threadably engaged with the helical convolutions of the cable armor and wherein one end portion of the spring-like element extends longitudinally away from the helical turns in a direction generally parallel to the axis of the helical turns and projects beyond the end of the cable armor to position the end of the element in a readily accessible location for connection of a grounding conductor thereto.

8. The combination according to claim 7 additionally including a flexible sleeve of generally cylindrical configuration positioned in surrounding relation to said spring-like element and to the end portion of said cable armor on which the spring-like element is mounted, and said sleeve having an axially extending opening at one end thereof of an inside diameter corresponding substantially to the outside diameter of the cable armor, and said sleeve having cylindrical side wall portions positioned in tight engagement with said cable armor.

9. The combination according to claim 8 wherein the end portion of said sleeve opposite said axially extending opening has a relatively small restricted passageway extending therethrough, and said one end portion of said spring-like element projects outwardly from the sleeve through said restricted passageway.

10. The combination according to claim 9 wherein said sleeve includes fastener means in the form of a projection extending from said closed end of the sleeve and being adapted for securing the sleeve to a restricted knock-out opening in an electrical panel, said fastener means being deformable and adapted for passing through the restricted knock-out opening and thereafter resiliently returning to its original configuration for securing the sleeve to the panel.

11. In a termination for armored electrical cable of the type having a protective flexible cable armor formed by interlocked helical convolutions of a metallic strip, the combination with said cable armor of a connector mounted on an end portion of the cable armor and serving to permit securing the cable to a knock-out opening of an electrical panel while also facilitating securing a grounding conductor to the cable armor, said connector comprising:

a flexible sleeve of generally cylindrical configuration having an axially extending opening at one end thereof of an inside diameter corresponding substantially to the outside diameter of the cable armor and being adapted for receiving therein and tightly engaging the end portion of the cable armor, the opposite end portion of the sleeve having a relatively small restricted passageway extending therethrough and including fastener means in the form of a projection extending from said opposite end of said sleeve and formed integral therewith, said fastener means being deformable for passing through a restricted knock-out opening of an electrical panel and thereafter resiliently returning to its original configuration for securing the sleeve to the panel, an electrically conductive spring-like element having a plurality of helical turns of a spacing and pitch corresponding to the spacing and pitch of the helical convolutions of said cable armor, said spring-like element being positioned on an end portion of the cable armor with the helical turns thereof being threadably engaged with the helical convolutions of the cable armor, and wherein one end portion of the spring-like element is substantially straight and extends longitudinally in a direction generally parallel to the axis of the helical turns and projects beyond the end of the cable armor for facilitating connection of a grounding conductor thereto, said cylindrical sleeve receiving said spring-like element and the end portion of the cable armor to which it is secured and forming a seal therewith, with said one end portion of said spring-like element extending through said restricted passageway in the sleeve and projecting from sleeve so as to be readily accessible for connection of a grounding conductor thereto.

12. The combination according to claim 11 wherein said restricted passageway in said sleeve is of such a relatively small size as to be substantially filled by the projecting end portion of said spring-like element and the electrical conductors of the cable so as to prevent the deformable fastener means of said sleeve from thereafter deforming to permit the sleeve to become disconnected from the panel.

* * * * *